US010597977B2

(12) United States Patent
Thomas et al.

(10) Patent No.: US 10,597,977 B2
(45) Date of Patent: Mar. 24, 2020

(54) CLOSING SLEEVE ASSEMBLY WITH PORTED SLEEVE

(71) Applicant: Halliburton Energy Services, Inc., Houston, TX (US)

(72) Inventors: Phillip Terry Thomas, The Colony, TX (US); Jason Earl Davis, Rowlett, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/755,000

(22) PCT Filed: Sep. 29, 2015

(86) PCT No.: PCT/US2015/052941
§ 371 (c)(1),
(2) Date: Feb. 23, 2018

(87) PCT Pub. No.: WO2017/058173
PCT Pub. Date: Apr. 6, 2017

(65) Prior Publication Data

US 2018/0363419 A1 Dec. 20, 2018

(51) Int. Cl.
*E21B 34/10* (2006.01)
*E21B 34/14* (2006.01)
(Continued)

(52) U.S. Cl.
CPC ..... *E21B 34/14* (2013.01); *E21B 17/10* (2013.01); *E21B 34/10* (2013.01); *E21B 43/04* (2013.01)

(58) Field of Classification Search
CPC ..... E21B 17/10; E21B 34/10; E21B 34/14; E21B 43/04
See application file for complete search history.

(56) References Cited

U.S. PATENT DOCUMENTS 3,071,193 A * 1/1963 Raulins ..... E21B 34/14 166/332.4
3,527,297 A * 9/1970 Todd ..... E21B 33/146 166/154
3,633,671 A * 1/1972 Nelson ..... E21B 34/14 166/318
(Continued)

FOREIGN PATENT DOCUMENTS

WO 2012/051705 4/2012

OTHER PUBLICATIONS

International Search Report and Written Opinion for PCT Patent Application No. PCT/US2015/052941, dated Jun. 16, 2016; 15 pages.

*Primary Examiner* — Matthew R Buck
(74) *Attorney, Agent, or Firm* — Baker Botts L.L.P.

(57) ABSTRACT

A closing sleeve assembly with a ported sleeve is disclosed. The closing sleeve assembly includes a housing; a port formed in the housing; a sealing surface formed in the housing adjacent to the port; and a closing sleeve configured to move between an open position and a closed position. The closing sleeve includes an uphole portion configured to substantially cover the sealing surface when the closing sleeve is moved to the open position; a port formed in the closing sleeve and configured to substantially overlap with the port formed in the housing when the closing sleeve is in the open position; and a seal configured to engage with the sealing surface to form a fluid and pressure tight seal when the closing sleeve is in the closed position.

18 Claims, 4 Drawing Sheets

(51) Int. Cl.
*E21B 17/10* (2006.01)
*E21B 43/04* (2006.01)

(56) References Cited

U.S. PATENT DOCUMENTS

| | | | | |
|---|---|---|---|---|
| 4,246,968 | A | 1/1981 | Jessup et al. | |
| 5,156,220 | A * | 10/1992 | Forehand | E21B 33/1208 166/332.7 |
| 5,316,084 | A * | 5/1994 | Murray | E21B 33/1208 166/332.4 |
| 6,189,619 | B1 | 2/2001 | Wyatt et al. | |
| 6,371,208 | B1 * | 4/2002 | Norman | E21B 34/06 166/334.4 |
| 7,066,264 | B2 | 6/2006 | Bissonnette et al. | |
| 7,363,981 | B2 * | 4/2008 | Coon | E21B 34/14 166/332.1 |
| 7,703,510 | B2 * | 4/2010 | Xu | E21B 43/26 166/177.5 |
| 8,540,019 | B2 | 9/2013 | Hofman et al. | |
| 8,657,010 | B2 | 2/2014 | Ward et al. | |
| 8,695,716 | B2 | 4/2014 | Ravensbergen | |
| 8,876,083 | B2 * | 11/2014 | Black | F16K 3/26 166/320 |
| 8,960,295 | B2 | 2/2015 | Arizmendi, Jr. et al. | |
| 8,978,773 | B2 | 3/2015 | Tilley | |
| 9,464,506 | B2 * | 10/2016 | Coon | E21B 34/102 |
| 9,500,063 | B2 * | 11/2016 | Greenan | E21B 34/102 |
| 10,156,124 | B2 * | 12/2018 | Guzman | E21B 34/14 |
| 2003/0056951 | A1 * | 3/2003 | Kaszuba | E21B 34/101 166/250.01 |
| 2012/0097386 | A1 | 4/2012 | Ward et al. | |
| 2013/0168099 | A1 * | 7/2013 | Themig | E21B 34/103 166/308.1 |
| 2014/0262312 | A1 | 9/2014 | Tilley | |

* cited by examiner

CLOSING SLEEVE ASSEMBLY WITH PORTED SLEEVE

RELATED APPLICATIONS

This application is a U.S. National Stage Application of International Application No. PCT/US2015/052941 filed Sep. 29, 2015, which designates the United States, and which is incorporated herein by reference in its entirety.

TECHNICAL FIELD

The present disclosure is related to downhole tools for use in a wellbore environment and more particularly to closing sleeve assemblies used in a well system during gravel packing operations.

BACKGROUND OF THE DISCLOSURE

Production fluids, including hydrocarbons, water, sediment, and other materials or substances found in a downhole formation, flow out of the surrounding formation into a wellbore and then ultimately out of the wellbore. Sand and other fine particulates are often carried from the formation into the wellbore by the production fluids. During well completion, a steel screen is placed in the wellbore and the surrounding annulus is packed with gravel to inhibit particulate flow from the formation.

BRIEF DESCRIPTION OF THE DRAWINGS

A more complete and thorough understanding of the various embodiments and advantages thereof may be acquired by referring to the following description taken in conjunction with the accompanying drawings, in which like reference numbers indicate like features, and wherein.

DETAILED DESCRIPTION OF THE DISCLOSURE

To protect the sealing surface in a closing sleeve assembly from erosion caused by the proppant slurry flowing over the surface, a protective sleeve may be positioned over the sealing surface. Embodiments of the present disclosure and its advantages may be understood by referring to FIGS. 1 through 5, where like numbers are used to indicate like and corresponding parts.

Figure 1:
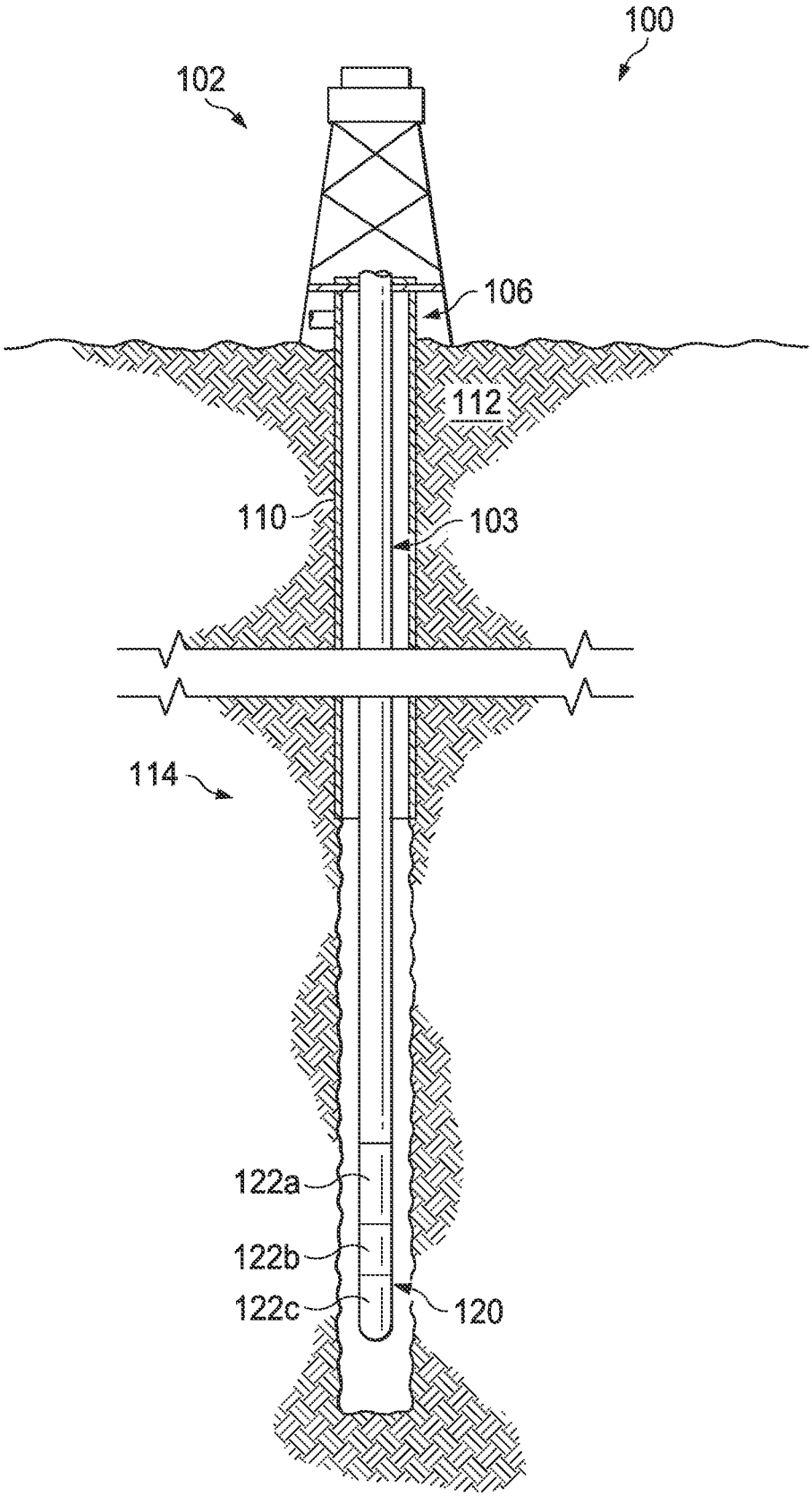
FIG. 1 is an elevation view of a well system.

FIG. 1 is an elevation view of a well system. Well system 100 includes well surface or well site 106. Various types of equipment such as a rotary table, drilling fluid or production fluid pumps, drilling fluid tanks (not expressly shown), and other drilling or production equipment may be located at well surface or well site 106. For example, well site 106 may include drilling rig 102 that may have various characteristics and features associated with a land drilling rig. However, downhole assemblies incorporating teachings of the present disclosure may be satisfactorily used with drilling equipment located on offshore platforms, drill ships, semi-submersibles and drilling barges (not expressly shown).

Well system 100 may also include production string 103, which may be used to produce hydrocarbons such as oil and gas and other natural resources such as water from formation 112 via wellbore 114. Production string 103 may also be used to inject hydrocarbons such as oil and gas and other natural resources such as water into formation 112 via wellbore 114. As shown in FIG. 1, wellbore 114 is substantially vertical (e.g., substantially perpendicular to the surface). Although not illustrated in FIG. 1, portions of wellbore 114 may be substantially horizontal (e.g., substantially parallel to the surface), or at an angle between vertical and horizontal.

The location of various components may be described relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Well system 100 may also include downhole assembly 120 coupled to production string 103. Downhole assembly 120 may be used to perform operations relating to the completion of wellbore 114, production of hydrocarbons and other natural resources from formation 112 via wellbore 114, injection of hydrocarbons and other natural resources into formation 112 via wellbore 114, and/or maintenance of wellbore 114. Downhole assembly 120 may be located at the end of wellbore 114 or at a point uphole from the end of wellbore 114. Downhole assembly 120 may be formed from a wide variety of components configured to perform these operations. For example, components 122*a*, 122*b* and 122*c* of downhole assembly 120 may include, but are not limited to, closing sleeve assemblies, screens, flow control devices, slotted tubing, packers, valves, sensors, and actuators. The number and types of components 122 included in downhole assembly 120 may depend on the type of wellbore, the operations being performed in the wellbore, and anticipated wellbore conditions.

Fluids, including hydrocarbons, water, and other materials or substances, may be injected into wellbore 114 and formation 112 via production string 103 and downhole assembly 120. For example, during gravel pack operations a proppant slurry including proppant particles mixed with a fluid may be injected into wellbore 114 via a closing sleeve assembly 122 of downhole assembly 120 and production string 103. In other examples, a temporary string (not expressly shown) that is part of a service tool string may be used in place of production string 103. The proppant particles may include naturally occurring sand grains, man-made or specially engineered particles, such as resin-coated sand or high-strength ceramic materials like sintered bauxite. The proppant slurry flows out of closing sleeve assembly 122 through a port in a housing of closing sleeve assembly 122. (shown in FIGS. 2-5). The flow of the proppant slurry through the port in the housing is controlled by a closing sleeve (shown in FIGS. 2-3). For example, in the closed position, the closing sleeve extends to cover the port in the housing and form a fluid and pressure tight seal with surfaces of the housing adjacent to the port, thus preventing the proppant slurry from flowing through the port in the housing. In the open position, the closing sleeve is retracted to permit the proppant slurry to flow through the port in the housing.

The flow of the proppant slurry through the port in the housing may cause the surfaces of the housing over which the proppant slurry flows to erode. Surface erosion may be particularly problematic where the eroded surface is a sealing surface. For example, the flow of the proppant slurry over surfaces of the housing adjacent to the port (shown in FIGS. 2-3) may erode the surfaces and thus alter the texture and/or profile of the surfaces, which may inhibit the closing sleeve from forming a fluid and pressure tight seal with surfaces of the housing adjacent to the port. To protect the surfaces of the housing adjacent to the port from erosion caused by flow of the proppant slurry, the closing sleeve may be configured such that a portion of the closing sleeve covers the sealing surface and thereby protects it from the flow of proppant slurry. The features and configuration of such a closing sleeve are discussed in detail in conjunction with FIGS. 2-4.

Figure 2:
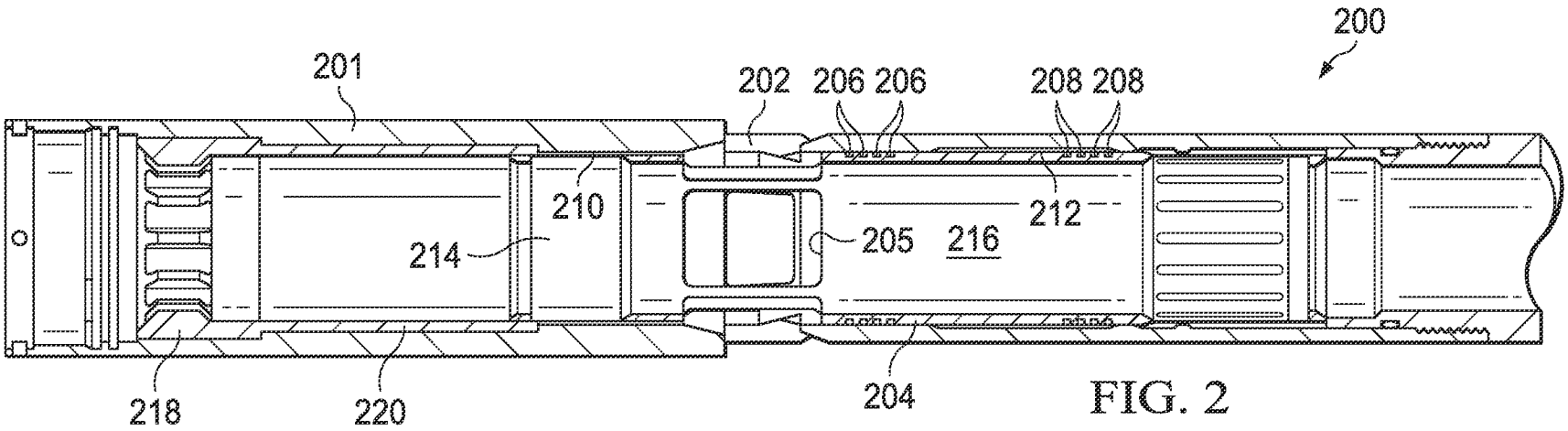
FIG. 2 is a cross-sectional view of a closing sleeve assembly including a closing sleeve in an open position.
Figure 3:
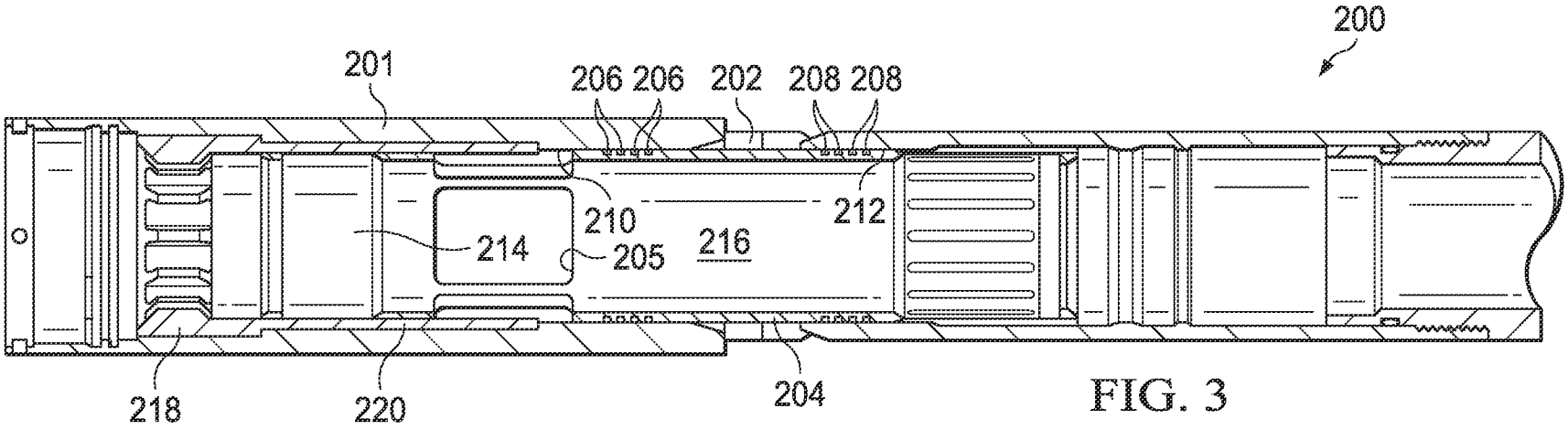
FIG. 3 is a cross-sectional view of a closing sleeve assembly including a closing sleeve in a closed position.

FIGS. 2 and 3 are cross-sectional views of a closing sleeve assembly including a closing sleeve. Specifically, FIG. 2 is a cross-sectional view of a closing sleeve assembly including a closing sleeve in an open position, and FIG. 3 is a cross-sectional view of a closing sleeve assembly including a closing sleeve in a closed position.

As shown in FIGS. 2 and 3, closing sleeve assembly 200 includes housing 201, which includes port 202 through which a proppant slurry flows into wellbore 114 (shown in FIG. 1). Closing sleeve assembly 200 also includes closing sleeve 204, which includes uphole portion 214, downhole portion 216, port 205, and seals 206 and 208. Additional details regarding the features of closing sleeve 204 are discussed below in conjunction with FIG. 4. Closing sleeve 204 may be extended and retracted to move between a closed position (shown in FIG. 3) and an open position (shown in FIG. 2). Closing sleeve assembly 200 also includes a release ring 218 disposed in housing 201 that engages with closing sleeve 204 to maintain alignment of closing sleeve 204 relative to housing 201. For example, release ring 218 includes fingers 220 that engage with slots 402 (shown in FIG. 4) formed in closing sleeve 204. The engagement of fingers 220 with slots 402 (shown in FIG. 4) maintain alignment of closing sleeve 204 relative to housing 201 as closing sleeve 204 is moved between the open and closed positions. Additional details regarding the features of release ring 218 are discussed below in conjunction with FIG. 5.

When closing sleeve 204 is in the closed position (shown in FIG. 3), downhole portion 216 of closing sleeve 204 covers port 202 and seals 206 and 208 engage with sealing surfaces 210 and 212 (respectively) to form a fluid and pressure tight seal, thus preventing proppant slurry from flowing through port 202. Seals 206 and 208 may be a molded seal, such as an O-ring, and may be made of an elastomeric material or a non-elastomeric material such as a thermoplastic including, for example, polyether ether ketone (PEEK) or Teflon®. The elastomeric material may be formed from compounds including, but not limited to, natural rubber, nitrile rubber, hydrogenated nitrile, urethane, polyurethane, fluorocarbon, perflurocarbon, propylene, neoprene, hydrin, etc. Although four seals 206 are depicted in FIGS. 2 and 3, any number of seals 206 may be used. Similarly, although four seals 208 are depicted in FIGS. 2 and 3, any number of seals 208 may be used.

When closing sleeve 204 is moved to the open position (shown in FIG. 2), closing sleeve 204 is retracted to a position in which port 205 is aligned with port 202 such that the opening of port 205 substantially overlaps with the opening of port 202. When port 205 is aligned with port 202 in this manner, the flow of proppant slurry through port 202 and into wellbore 114 (shown in FIG. 1) is permitted. As explained above, fingers 220 of release ring 218 engage with slots 402 (shown in FIG. 4A) of closing sleeve 204 to maintain alignment of closing sleeve 204 relative to housing 201. The engagement between fingers 220 and slots 402 (shown in FIG. 4A) prevent closing sleeve 204 from rotating relative to housing 201, which may prevent port 205 from aligning with port 202 such that the opening of port 205 substantially overlaps with the opening of port 202 when closing sleeve 204 is in the open position. If closing sleeve 204 rotates within housing 201 such that the opening of port 205 does not substantially overlap with the opening of port 202, the flow of proppant slurry through port 202 and into wellbore 114 (shown in FIG. 1) may be impeded. To protect sealing surface 210 from erosion caused by the flow of proppant slurry over surface 210, which may alter the texture and/or profile of sealing surface 210 and inhibit seals 206 from forming a fluid and pressure tight seal with sealing surface 210, uphole portion 214 of closing sleeve 204 is configured to cover sealing surface 210 when closing sleeve 204 is in the open position (shown in FIG. 2).

Figure 4:
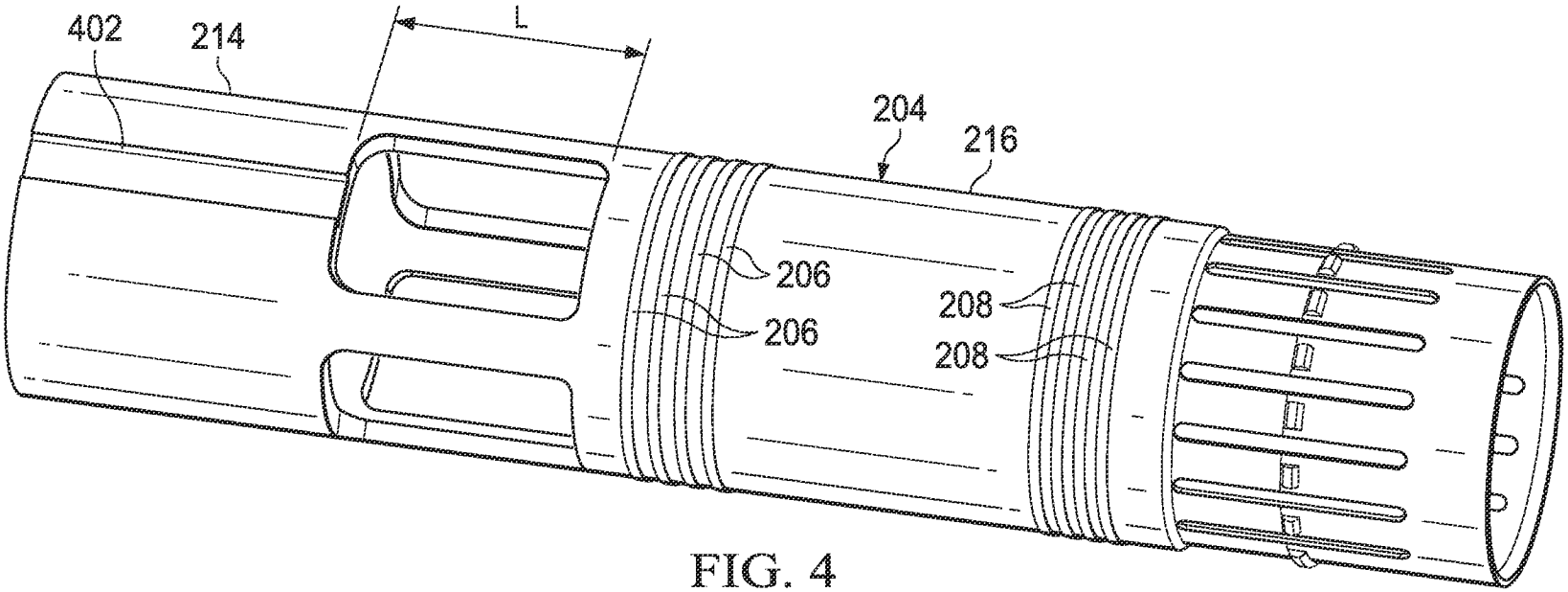
FIG. 4 is a perspective view of a closing sleeve of a closing sleeve assembly.

FIG. 4 is a perspective view of a closing sleeve. As shown in FIG. 4, and discussed above in conjunction with FIGS. 2 and 3, closing sleeve 204 includes uphole portion 214, downhole portion 216, port 205 positioned between uphole portion 214 and downhole portion 216, and seals 206 and 208. Closing sleeve 204 also includes slots 402 formed in the surface of closing sleeve 204. Slots 402 engage with fingers 220 of release ring 218 (shown in FIGS. 2-3 and 5) to prevent rotation of closing sleeve 204 within housing 201 (shown in FIGS. 2 and 3). As explained above with respect to FIGS. 2 and 3, rotation of closing sleeve 204 within housing 201 may prevent port 205 from aligning with port 202 of housing 201 such that the opening of port 205 substantially overlaps with the opening of port 202 when closing sleeve 204 is in the open position. If closing sleeve 204 rotates within housing 201 such that the opening of port 205 does not substantially overlap with the opening of port 202, the flow of proppant slurry through port 202 and into wellbore 114 (shown in FIG. 1) may be impeded.

Port 205 may be sized such that the opening of port 205 is larger than the opening of port 202 in housing 201. For example, the opening of port 205 may be longer than the opening of port 202 in housing 201. The length of port 205 is indicated by dimension L in FIG. 4. By sizing port 205 in this manner, the distance that closing sleeve 204 must be retracted in order for the opening of port 205 to substantially overlap with the opening of port 202 when the closing sleeve is in the open position need not be controlled with exact precision.

Closing sleeve 204 may be formed of an erosion resistant material, including but not limited to tungsten carbide and hardened tool steel. Closing sleeve 204 may also include an erosion resistant coating. For example, closing sleeve 204 may include a base formed of a metal or alloy to which an erosion resistant coating has been applied. The erosion resistant coating may, for example, include Nedox®, Hardide®, or a coating treated to be erosion resistant through methods including, for example, laser cladding, quench polish quench (QPQ) treatment, and nitro-carburizing. The erosion resistant coating may be applied to the entire closing sleeve 204 or portions thereof (e.g., uphole portion 214 of closing sleeve 204) Closing sleeve 204 may also be hardened to increase its erosion resistance.

Figure 5:
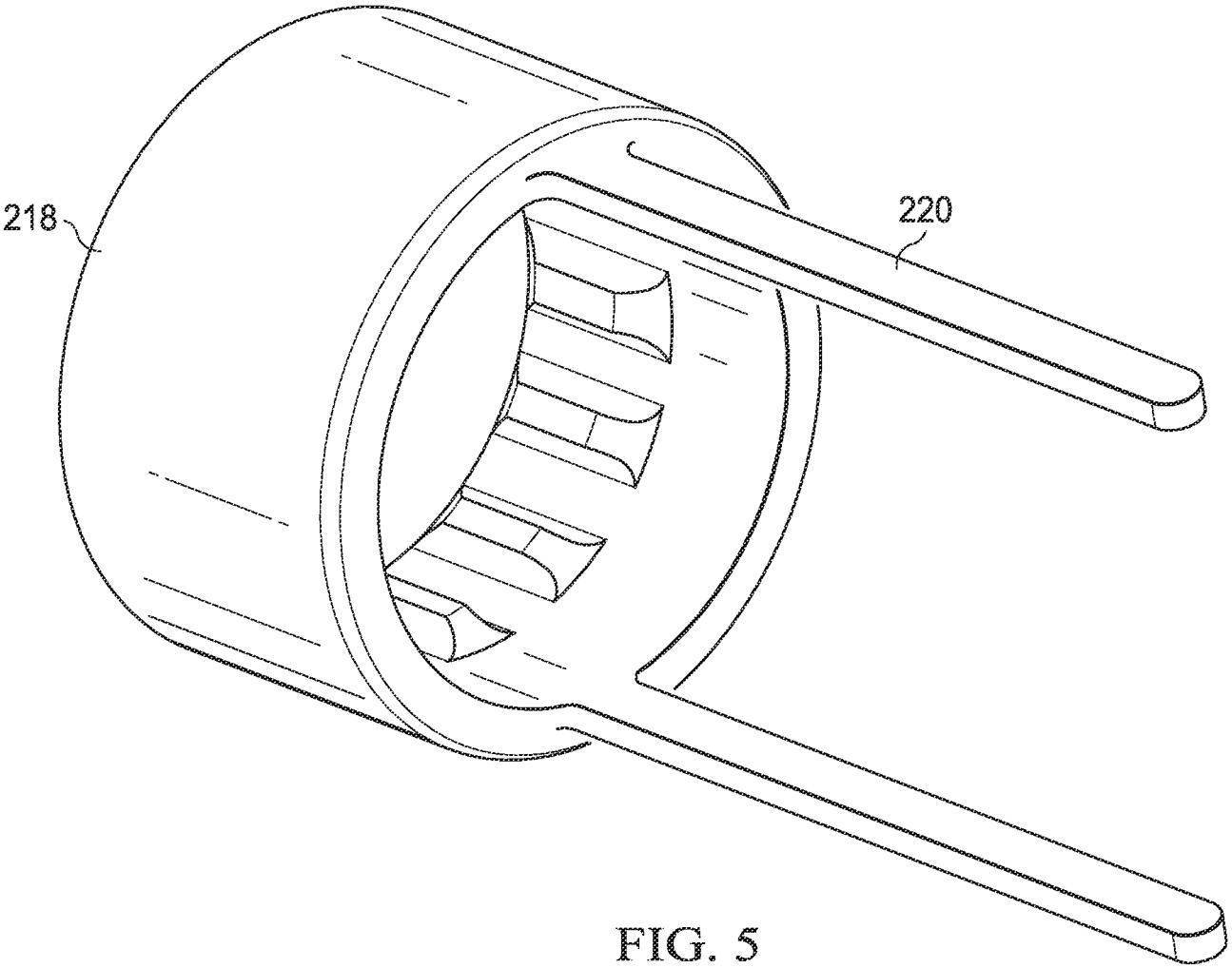
FIG. 5 is a perspective view of a release ring of a closing sleeve assembly.

FIG. 5 is a perspective view of a release ring. As shown in FIG. 5, and discussed above in conjunction with FIGS. 2 and 3, release ring 218 includes fingers 220 that engage with slots 402 (shown in FIG. 4) formed in closing sleeve 204. The engagement of fingers 220 with slots 402 (shown in FIG. 4) maintain alignment of closing sleeve 204 relative to housing 201 as closing sleeve 204 is moved between the open and closed positions. Although two fingers 220 are shown in FIG. 5, any number of fingers 220 may be used.

Release ring 218 may be formed of an erosion resistant material, including but not limited to tungsten carbide and hardened tool steel. Release ring 218 may also include an erosion resistant coating. For example, release ring 218 may include a base formed of a metal or alloy to which an erosion resistant coating has been applied. The erosion resistant coating may, for example, include Nedox®, Hardide®, or a coating treated to be erosion resistant through methods including, for example, laser cladding, quench polish quench (QPQ) treatment, and nitro-carburizing. The erosion resistant coating may be applied to the entire release ring 218 or portions thereof (e.g., fingers 220). Release ring 218 may also be hardened to increase its erosion resistance.

Embodiments disclosed herein include:

A. A closing sleeve assembly including a housing; a port formed in the housing; a sealing surface formed in the housing adjacent to the port; and a closing sleeve configured to move between an open position and a closed position. The closing sleeve includes an uphole portion configured to substantially cover the sealing surface when the closing sleeve is moved to the open position; a port formed in the closing sleeve and configured to substantially overlap with the port formed in the housing when the closing sleeve is in the open position; and a seal configured to engage with the sealing surface to form a fluid and pressure tight seal when the closing sleeve is in the closed position.

B. A closing sleeve including an uphole portion configured to substantially cover a sealing surface of a housing when the closing sleeve is moved to an open position; a port formed in the closing sleeve and configured to substantially overlap with a port formed in the housing when a closing sleeve is in the open position; and a seal configured to engage with the sealing surface to form a fluid and pressure tight seal when the closing sleeve is in the closed position.

C. A well system including a string; and a closing sleeve assembly coupled to and disposed downhole from the production string. The closing sleeve assembly including a housing including a port formed in the housing and a sealing surface formed in the housing adjacent to the port; and a closing sleeve configured to move between an open position and a closed position. The closing sleeve includes an uphole portion configured to substantially cover the sealing surface when the closing sleeve is moved to the open position; a port formed in the closing sleeve and configured to substantially overlap with the port formed in the housing when the closing sleeve is in the open position; and a seal configured to engage with the sealing surface to form a fluid and pressure tight seal when the closing sleeve is in the closed position.

Each of embodiments A, B, and C may have one or more of the following additional elements in any combination: Element 1: further comprising a release ring disposed uphole from the closing sleeve and configured to engage with the closing sleeve to prevent rotation of the closing sleeve relative to the housing. Element 2: wherein: the closing sleeve includes a slot formed in the surface; and the release ring includes a finger extending from the downhole end and configured to engage with the slot formed in the surface of the closing sleeve to prevent rotation of the closing sleeve relative to the housing. Element 3: wherein the closing sleeve is formed of an erosion resistant material. Element 4: wherein the release ring is formed of an erosion resistant material. Element 5: wherein the closing sleeve is coated with an erosion resistant coating. Element 6: wherein the release ring is coated with an erosion resistant coating. Element 7: wherein the seal is positioned in a slot or groove formed in the closing sleeve.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A closing sleeve assembly, comprising:

a housing;

a port formed in the housing;

a sealing surface formed in the housing adjacent to the port;

a closing sleeve configured to move between an open position and a closed position, the closing sleeve including:

an uphole portion configured to substantially cover the sealing surface when the closing sleeve is moved to the open position;

a port formed in the closing sleeve and configured to substantially overlap with the port formed in the housing when the closing sleeve is in the open position; and a seal configured to engage with the sealing surface to form a fluid and pressure tight seal when the closing sleeve is in the closed position; and a release ring disposed uphole from the closing sleeve and configured to engage with the closing sleeve to prevent rotation of the closing sleeve relative to the housing.

2. The closing sleeve assembly of claim 1, wherein:

the closing sleeve includes a slot formed in the uphole portion; and the release ring includes a finger extending from the downhole end and configured to engage with the slot formed in the uphole portion of the closing sleeve to prevent rotation of the closing sleeve relative to the housing.

3. The closing sleeve assembly of claim 1, wherein the closing sleeve is formed of an erosion resistant material.

4. The closing sleeve assembly of claim 1, wherein the release ring is formed of an erosion resistant material.

5. The closing sleeve assembly of claim 1, wherein the closing sleeve is coated with an erosion resistant coating.

6. The closing sleeve assembly of claim 1, wherein the release ring is coated with an erosion resistant coating.

7. The closing sleeve assembly of claim 1, wherein the seal is positioned in a slot or groove formed in the closing sleeve.

8. A closing sleeve, comprising:

an uphole portion configured to substantially cover a sealing surface of a housing when the closing sleeve is moved to an open position;

a port formed in the closing sleeve and configured to substantially overlap with a port formed in the housing when the closing sleeve is in the open position;

a seal configured to engage with the sealing surface to form a fluid and pressure tight seal when the closing sleeve is in the closed position; and a slot on the uphole portion configured to engage with a release ring disposed within the housing uphole from the closing sleeve to prevent rotation of the closing sleeve relative to the housing.

9. The closing sleeve of claim 8, wherein the closing sleeve is formed of an erosion resistant material.

10. The closing sleeve of claim 8, wherein the closing sleeve is coated with an erosion resistant coating.

11. The closing sleeve of claim 8, wherein the seal is positioned in a slot or groove formed in the closing sleeve.

12. A well system comprising:

a string; and a closing sleeve assembly coupled to and disposed downhole from the string, the closing sleeve assembly comprising:

a housing including a port formed in the housing and a sealing surface formed in the housing adjacent to the port;

a closing sleeve configured to move between an open position and a closed position, the closing sleeve including:

an uphole portion configured to substantially cover the sealing surface when the closing sleeve is moved to the open position;

a port formed in the closing sleeve and configured to substantially overlap with the port formed in the housing when the closing sleeve is in the open position; and a seal configured to engage with the sealing surface to form a fluid and pressure tight seal when the closing sleeve is in the closed position; and a release ring disposed uphole from the closing sleeve and configured to engage with the closing sleeve to prevent rotation of the closing sleeve relative to the housing.

13. The well system of claim 12, wherein:

the closing sleeve includes a slot formed in the uphole portion; and the release ring includes a finger extending from the downhole end and configured to engage with the slot formed in the uphole portion of the closing sleeve to prevent rotation of the closing sleeve relative to the housing.

14. The well system of claim 12, wherein the closing sleeve is formed of an erosion resistant material.

15. The well system of claim 12, wherein the release ring is formed of an erosion resistant material.

16. The well system of claim 12, wherein the closing sleeve is coated with an erosion resistant coating.

17. The well system of claim 12, wherein the release ring is coated with an erosion resistant coating.

18. The well system of claim 12, wherein the seal is positioned in a slot or groove formed in the closing sleeve.

* * * * *